United States Patent [19]

Duport

[11] Patent Number: 5,037,219

[45] Date of Patent: Aug. 6, 1991

[54] COMPOSITE TAPE FOR LABEL PRINTING MACHINES

[76] Inventor: Jean C. Duport, 35 Route de Villemur, F-31780 Castelginest, France

[21] Appl. No.: 263,031

[22] Filed: Oct. 26, 1988

[30] Foreign Application Priority Data

Oct. 26, 1987 [FR] France ..... 87 15240

[51] Int. Cl.[5] ..... B41J 31/05

[52] U.S. Cl. ..... 400/241; 428/913

[58] Field of Search ..... 428/411.1, 913, 535, 428/537.1; 282/27 R, 27 A, 27 S, 28 R, 28 A; 400/499, 613, 237, 241, 241.1

[56] References Cited

U.S. PATENT DOCUMENTS 4,328,977 5/1982 Ozawa et al. ..... 428/535

4,721,635 1/1988 Helinski ..... 156/277

FOREIGN PATENT DOCUMENTS 7610227 3/1978 Netherlands ..... 400/237

*Primary Examiner*—David A. Wiecking

*Attorney, Agent, or Firm*—Horst M. Kasper

[57] ABSTRACT

The invention relates to a composite tape for printing machines. A band with printable zones is arranged on the band at uniform intervals. An ink ribbon, of a size equal or less to that of the band, covers at least the imprintable zones and is electrostatically affixed to the printable zones on the band.

10 Claims, 3 Drawing Sheets

COMPOSITE TAPE FOR LABEL PRINTING MACHINES

BACKGROUND OF THE INVENTION

1. Field of the Invention

The present invention relates to a composite tape for printing machines and to a printing machine using such a composite tape.

2. Brief Description of the Background of the Invention Including Prior Art

Machines for the printing of labels by thermal transfer techniques are already known. Such machines are capable of automatically printing a large sequence of labels depending on variables entered into the memories. These labels are intended for example for the markings of various products to be placed for sale and the markings which they receive can, for example, be provided as bar codes.

The known printing machines for thermal transfer are furnished with a heating print head under which a label tape is continuously carried along. The machines are likewise furnished with an ink ribbon which is continuously carried along under the print head against the label tape, at the same speed as the speed of the label tape. The print head is provided with a plurality of selectively heated points in order to form the corresponding markings on the label. The transfer of the ink from the ink ribbon onto the labels is effected in this case by heating.

The conventional printing machines thus use two consumables known as the ink ribbon and the label tape. One of the numerous inconveniences resulting from the use of two consumables lies in the fact that the ribbon or, respectively, the tape are not always of the same length. If the printer operator is not careful, then the printing machine can keep on printing despite a complete unwinding, be it of the ink ribbon or be it of the label tape.

Another inconvenience is associated with the fact that the printer operator has to perform two operations on the machine, one for loading the ink ribbon and the other one for loading the label tape.

A further inconvenience is connected with the fact that the two operations cannot be performed simultaneously, which is basically due to the difference in length of the two consumables, i.e. of the ribbon or, respectively, the tape.

Printing machines are based on a concept to allow the printing of tapes for labels of different sizes. In order to satisfy the demand, the user of such a machine has to have in his possession the ink ribbons in sizes adapted to that of the label tapes and has therefore to keep in stock an amount of tapes and ribbons totalling twice the number of desired tapes.

SUMMARY OF THE INVENTION

1. Purposes of the Invention

It is an object of the present invention to remedy the inconveniences which are associated with conventional printing machines employing separate ink ribbons and label tapes.

It is a further object of the present invention to provide a printing machine for printing labels which dispenses with the requirement of providing both, an ink ribbon and a label tape.

It is another object of the present invention to provide a new composite ribbon tape for the printing of labels and a new machine which is capable of using such ribbon tape.

These and other objects and advantages of the present invention will become evident from the description which follows.

2. Brief Description of the Invention

The present invention provides for a composite tape for printing machines, where a band with printable zones is arranged on the band at uniform intervals. An ink ribbon having a size no larger than the band covers at least the printable zones and is affixed to the printable zones on the band.

The composite tape according to the present invention is characterized essentially in that it is formed by a band onto which printable zones are arranged uniformly spaced apart and by an ink ribbon covering the printable zones and fixed to these latter and/or to the band.

According to another characteristic of the invention, the printable zones are formed by the upper face of the self-adhesive and self-sticking labels, which are disposed at uniform distances along at least one row on the support band.

According to a further feature of the invention, the ink ribbon is fixed to the band and/or to the printable zones by an electrostatic effect, i.e. under the attractive force effect generated by the charges of opposite polarity respectively present on the ink ribbon and on the band and/or on the imprintable zones of the latter band.

This disposition is particularly advantageous since it allows the use of ink ribbons, where the size can be less than that of the support band and can be adapted to the size of the zones to be covered.

According to a further embodiment of the invention, the ribbon is of the same size as the band and the said ribbon and the said band are fixed one on top of the other at their respective edges.

The present invention has furthermore the purpose of providing a printing machine which utilizes the ribbon tape according to the invention. The printing machine in particular comprises a magazine in which there is disposed a ribbon tape placed on a spool, a heating print head, a driving means for a continuous advancement, which cooperates by adhering to the ribbon tape for conveying a new zone to be printed under the print head.

Detachable labels can be placed onto the band at regular intervals along one or several rows for forming imprintable zones with an upper face of a respective label such that the labels are positioned between the band and the ink ribbon. The labels can be spaced apart from each other and from the longitudinal edges of the band. Said band can play the role of support for the labels. The band can be formed by a translucent, silicone-treated paper.

According to the present invention, the printing machine for utilizing a composite tape comprises a magazine. A composite tape includes imprintable zones and a ribbon located adjacent to said imprintable zones. The composite tape is arranged on a roller. A heatable print head imprints imprintable zones by transfer of the ink from the ink ribbon to a respective imprintable zone. A continuous advance drive means cooperates frictionally with the composite tape for bringing, as desired, a new imprintable zone under print head. A command body controls and regulates the operation of the printing machine. Sensing and detecting means sense and detect the imprintable zones furnished above the print head and in the area of the travel course of the composite tape at an adjustable distance of this print head. The sensing and detecting means is transmittingly connected to the command body for emitting and sending signals destined for the command body of the machine which control an imprinting of the imprintable zone disposed under the print head after a predetermined delay period.

A guide rail can be solidly connected to a chassis and extend in parallel to the travel course of the composite tape. A frame can be supported on the guide rail. The sensing and detecting means of the imprintable zones can be fixedly mounted on the frame for being moved together with the frame along this guide rail and for being placed into a desired position.

The command body can include an electronic circuit. The sensing and detecting means can be formed by a detection sensor which emits and sends an electric signal when it detects the arrival of a label to the electronic circuit, which receives the electric signal emitted by the detection sensor so that only calibrated pulses are processed by the command body.

The detection member can sense the variation of luminous properties of the composite tape observable from a front face of the band where the front face is a face free from imprintable zones. The variation of the luminous property can result in the case where the imprintable zones are formed at upper faces of the labels, and where the translucent property of the support band and opacity of the ink ribbon and of the covering by the ink ribbon of the intervals separate the labels.

The sensing and detecting means can comprise an axle affixed to the frame. A constraint gauge of such type that its electric resistance can vary depending on a deformation to which the constraint gauge is subjected and contacting the axle and where the axle can actuate the constraint gauge. A wheel rotatably mounted on an axle can be affixed to a frame. Said wheel can be brought to press against the composite tape and can be disposed in such a way as to be able to turn around itself when the composite tape is carried along.

The sensing and detecting means can be formed by the roller rotatably mounted on an axle. The axle can be mounted in a fork. Preferably, the fork is affixed to a device for amplifying a rising and descending motion of the wheel. Said device can be a lever device and can carry electrical means for detecting the low and high positions of a mechanical reference mark fixed on the device. Said low and high positions can be representative of the position of the wheel, be it in a groove of the tape, indicating the presence of an interval, or be it on the bulge of the tape, indicating the presence of a label.

A method for printing, employing a composite tape with a printing machine, comprises the following steps: A composite tape is arranged on a roller coming from a magazine. Said composite tape includes imprintable zones and an ink ribbon located adjacent to said imprintable zones. Sensing and detecting means are transmittingly connected to a command body for emitting and sending signals destined for the command body of the machine. The operation of the printing machine is controlled and regulated with the command body. The composite tape frictionally engages with a continuous advance drive means for bringing, as desired, a new imprintable zone under a heatable print head. An imprintable zone is imprinted with the heateble print head by transfer of ink from the ink ribbon to a respective imprintable zone. Sensing means are provided to detect the imprintable zones furnished above the print head and in the area of the travel course of the composite tape at an adjustable distance of this print head. A following imprintable zone is placed under the print head after a predetermined delay period as controlled by the command body.

A guide rail can be solidly connected to a chassis and extend in parallel to the travel course of the composite tape. A frame can be supported on the guide rail. The sensing and detecting means of the imprintable zones can be fixedly mounted on the frame. The frame together with sensing and detecting means can be moved along the guide rail into a desired position.

An arrival of a label can be detected with the sensing and detecting means formed as a detection sensor. An electrical signal can be emitted and sent from the detection sensor to an electronic circuit. Said electronic circuit can receive the electric signal emitted by the detection sensor so that only calibrated pulses are processed by the command body.

Light rays are emitted from a body. A variation of luminous properties of the composite tape can be sensed, observable from a front face of the band with the detection sensor, where the front face is a face free from imprintable zones, and where the variation of the luminous property can result in the case where the imprintable zones are formed at upper faces of the labels, and in the case where the translucent property of the support band and opacity of the ink ribbon and of the covering by the ink ribbon of the intervals can separate the labels. A current can be generated in the detection sensor depending on the quantity of light it receives. The detection sensor can be associated with the body emitting light rays, which body can illuminate the front face of the support band, and which detection sensor can be positioned in such a way as to receive the light rays coming from the front face.

The machine according to the present invention is essentially characterized in that it carries above the print head a sensor means to detect the printable zones of the composite ribbon tape, which gives off and transmits a detection signal for each detected zone, based on which the printing of the printable zone, placed under the print head, is generated.

According to a further characteristic, the detection and sensor means of the label detect a luminosity variation of the ribbon tape, such as the transmission or reflection of light.

According to a further feature, the detection means of the label can detect the variation of the thickness of the composite ribbon tape.

Other advantages and features of the invention will be set forth in the description of a preferred embodiment which is given by way of example, which does not limit the invention when it refers to the attached drawing.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing, in which are shown several of the various possible embodiments of the present invention.

DESCRIPTION OF INVENTION AND PREFERRED EMBODIMENT

Figure 1:
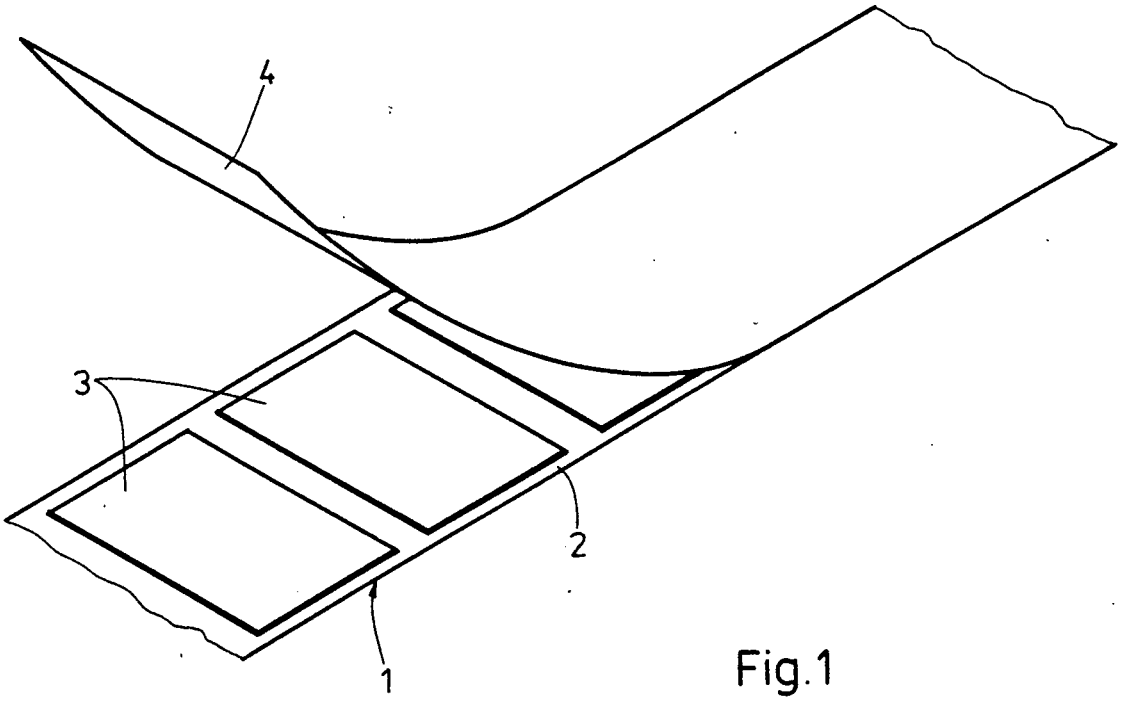
FIG. 1 is a perspective view of the invention composite ribbon tape being peeled apart.
Figure 2:
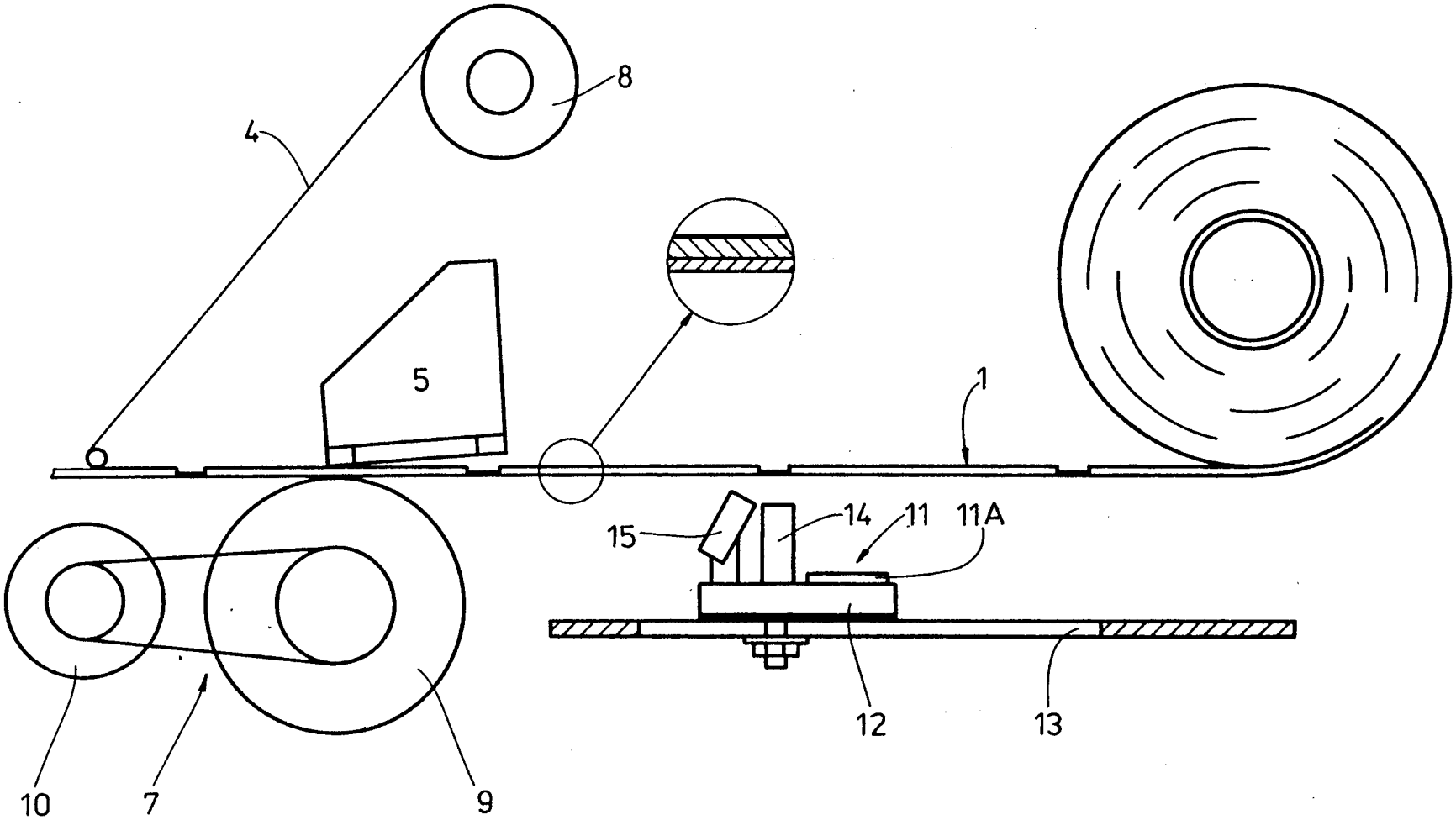
FIG. 2 is a schematic sectional view of a printing machine for labels according to the invention.
Figure 3:
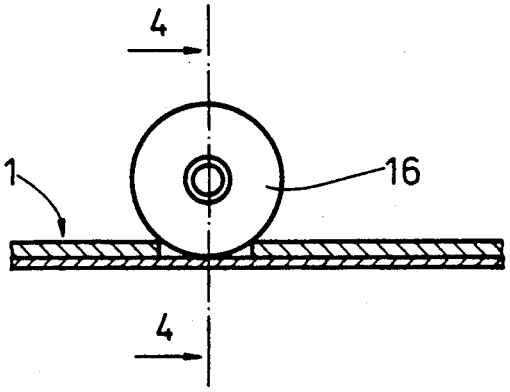
FIG. 3 is a sectional view of a second embodiment of the detection means of the label.
Figure 4:
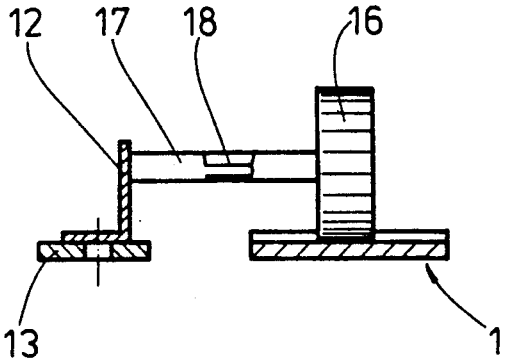
FIG. 4 is a sectional view along the section line A—A of FIG. 3.
Figure 5:
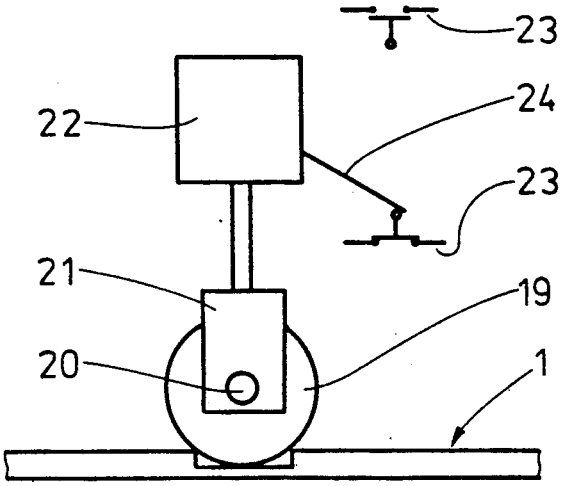
FIG. 5 is a sectional view of a third embodiment of the invention illustrating the detection means of the label.

Such as illustrated in FIG. 1, the tape 1 according to the invention comprises a band 2 on which printable zones are disposed uniformly spaced apart, and with an ink ribbon 4 of an equal or lesser size than that of the band covering at least the printable zones and affixed to these latter and/or to the band 2.

A composite tape 1 for printing machines is formed by a band 2 on which printable zones are arranged at uniform intervals and by an ink ribbon 4 of a size equal or less to that of the band 2. Said ink ribbon covers at least the imprintable zones and is affixed to the latter one and/or to the band 2.

The ink ribbon 4 can be affixed to the band 2 and/or to the zones imprintable by electrostatic effect, which means under the effect of the attractive force generated by electrical charges of opposite polarity respectively present on the ink ribbon 4 and on the band 2 and/or on the imprintable zone. The ink ribbon 4 and the band 2 can be affixed one to the other by their respective edges, with the said ink ribbon and the said band being of the same size. The ink ribbon 4 and the support band 2 can be affixed one to each other by stamping, by gluing, or by ultrasonic welding.

The imprintable zones can be formed by the upper face of detachable labels 3 placed at regular intervals along one or several rows, the ones spaced apart from the others and from the longitudinal edges of the band 2. This band can play the role of support for the labels 3 and can be formed by a translucent, silicone-treated paper.

A printing machine, utilizing a composite tape as described above, includes a magazine. There is disposed a tape 1 arranged on a roller, a heating print head 5 which imprints, by transfer of the ink of a ribbon 4, the imprintable zone which is located under it. A continuous advance drive means 7 cooperates frictionally with the tape 1 for bringing a new imprintable zone under print head 5. The machine is furnished, above the print head 5, on the travel course of the composite tape at an adjustable distance of this print point, with a sensing and detecting means 11 of the imprintable zones. Said sensing and detecting means 11 emits and sends a signal destined for the command bodies of the machine which command, at the end of a predetermined delay period, the imprinting of the imprintable zone disposed under the print head.

The sensing means 11 of the imprintable zones can be fixedly mounted on a frame 12 which, in turn, can be mounted on a guide rail 13 with the possibility of being displaced along this guide rail and of being locked in position. Said guide rail can be solidly connected to the chassis of the machine and can extend in parallel to the travel course of the composite tape.

The means 11 can be formed by a detection sensor which can emit and send an electric signal when it detects the arrival of a label, by an electronic circuit 11 which can restore in form or delay the electric signal emitted by the detection member so that only calibrated pulses are delivered to the command bodies of the machine.

The detection member can sense the variation of the luminous properties of the composite tape observable from the front face of the band 2, which means the face free from imprintable zones, where this variation of the luminous property can result in the case where the imprintable zones are formed by the upper faces of the labels, and where the translucent property of the support band and opacity of the ink ribbon and of the covering by this latter of the intervals separate the labels.

The detection means can be formed by an opto-electronic cell 14 which can generate a current depending on the quantity of light it receives. The said cell can be associated to a body 15 for the emission of light rays which can illuminate the front face of the support band and which can be positioned in such a way as to receive the light rays reflected by the said front face, or derived from this latter face.

The detection means can sense the variation of the thickness of the composite tape, with the imprintable zones of the latter being formed by the upper face of the labels 3 placed on the band 2.

The detection means can comprise a wheel 16 rotatably mounted on an axle 17 affixed to a frame 12. Said wheel can be brought to press against the composite tape and can be disposed in such a way as to be able to turn around itself when the composite tape is pulled along. The axle of the said wheel can receive a constraint gauge 18 of such type, where the electric resistance can vary depending on the deformation to which it is subjected.

The detection means can be formed by a roll 19 rotatably mounted on an axle 20 which in turn can be mounted in a fork 21. The fork 21 can be affixed to a device 22 for the amplification of the rising and descending motion of the wheel. Said device can be a lever device and can carry electrical means for detecting the low and high positions of a mechanical reference mark 24 fixed on the device. Said low and high positions can be representative of the position of the wheel, be it in a groove of the tape, indicating the presence of an interval, or be it on the bulge of the tape, indicating the presence of a label.

According to a first embodiment of the invention, the ink ribbon 4 is affixed by an electrostatic effect at the band and/or at the printable zones, this means under the effect of the attractive force generated by charges of opposite polarities present, respectively, on the ink ribbon 4 and on the band 2 and/or on the printable zones of the latter band.

According to this embodiment, the ribbon can have a smaller size than that of the band, and it can be adapted to the size of the printable zones.

Still according to this form of embodiment, the ink ribbon is made up by a polyester film of a thickness of between 3.5 to 10 micrometers covered with an ink coating. It is fairly obvious that the ink ribbon 4 can be affixed to the band 2 in further different ways.

Thus, the ink ribbon 4 and the band 2 will be of the same size and will be affixed to one another at their respective edges. According to a first embodiment, the ink ribbon 4 will be affixed by stamping to the band 2.

According to a second embodiment of the invention, the fixation of the ink ribbon 4 to the band 2 will be effected by gluing.

According to a third embodiment the fixation of the ink ribbon 4 to the band 2 will be effected by ultrasonic welding.

According to a preferred embodiment of the invention, the printable zones are formed by the upper face of the detachable, self-adhesive and self-sticking labels affixed onto the band at uniform intervals along one or several rows spaced apart from one another and from the edges of the said band.

According to this embodiment, the band 2 plays the role of a support. This band 2 can be formed by a paper coated with silicone to facilitate the removal of the labels, and the labels are formed by paper and are provided with a coating of an adhesive matter for being maintained on the layer of silicone-coated paper and for being able to adhesively adhere on the support onto which it will be placed later on.

According to another embodiment, the printable zones are arranged directly on the band 2. The band 2 can comprise transversal weakening lines in order to allow the band 2 to be subdivided into labels.

The machine according to the invention, using a composite ribbon tape such as previously defined, is, for example, an automatic printing machine for labels by thermal transfer.

In particular, such a machine comprises a magazine wherein there is disposed a tape 1 wound onto a roller, and a heating print head 5, where the composite tape is carried along under the heating print head 5. Said composite tape is in contact with the print head by the upper face of the ink ribbon 4. This print head is provided with a plurality of selectively heated points in order to form the desired marking on the printable zone of the composite tape 1 by a thermal transfer of the ink of the ribbon 4.

The machine furthermore comprises a driving motor means 7 which frictionally cooperates with the tape 1 for continuously carrying along the tape 1 under the print head.

The ink ribbon 4 is separated from the band 2 and is wound onto a hub 8 driven by a motor body above the print head and the drive means, by taking into account the direction of forward movement of the tape in the machine.

The band 2 support is rolled onto a hub which is driven in rotation by any suitable means or is directed toward a trimmer for separation of the labels.

The drive means 7 is formed by a small pulley 9 freely rotatable under the print head, which applies pressure against the composite ribbon tape in such a way as to carry along the tape under the said print head. The composite ribbon tape is embraced between the small pulley 9 and the print head. The adhesion coefficient of the composite ribbon tape against the print head is lesser than that of the small pulley 9 against the said tape. The small pulley 9 is engaged with a motor body 10 which can be an electric step motor.

According to the invention, the machine, disposed above the print head on the passage course of the composite tape, is furnished with a means 11 for detecting of the labels at an adjustable predetermined distance from this print point. When a label is detected, the means 11 emits and sends a signal directed to the command members of the machine. At the end of a delay period determined by an adjustable or non-adjustable delay means, said command members of the machine order the printing of the printable zone placed under the print head.

The means 11 can be formed by a detection and sensing member that emits and sends an electric signal when it detects an arrival of an imprintable zone and by an electronic circuit 11A, which restores in form or delays the electric signal emitted by the detection and sensing means such that only calibrated pulses are delivered to the command members of the machine.

Preferably, the detection means of the imprintable zones of the tape is fixedly mounted on a frame 12 which is mounted on a guide rail 13 with the possibility of displacement along the guide rail 13 and of the locking in position with the aid of a locking screw. The guide rail is fixed on the chassis of the machine. This guide rail extends parallel to the travel course of the composite tape 1 such that the frame 12 and the means 11 which it carries can be displaced and moved along one portion of this passage course. This arrangement allows to control the gap between the detection and sensing means 11 and the print head of the machine, where this gap can be equal to the value of the distance step of the imprintable zones or else to a multiple of said value.

According to a preferred embodiment of the invention, the detection means detects the variation in the luminous properties of the composite ribbon tape observable from the outer face of the band 2, i.e. the face free of imprintable zones. The variation of the luminous properties results from the translucent properties of the support band 2, from the opacity of the ink ribbon 4, and from the covering by the latter of the intervals separating the labels, for a composite ribbon tape where the imprintable zones are formed by the upper face of the labels affixed in a row onto a translucent silicone-treated band 2. Upon illumination of the front face of the tape, there appear clear zones corresponding to the labels and dark zones corresponding to the intervals between the labels. The detection means can advantageously be provided by an opto-electronic cell 14, which opto-electronic cell 14 generates a current depending on the quantity of light it receives. This cell 14 can be associated to a member 15 for the emission of light rays or beams, such as a lamp, which illuminates the front face of the support band 2 and which can be positioned in such a way as to receive the light rays reflected by the said front face or derived from the latter.

According to a particular embodiment, the lamp 15 illuminates the composite ribbon tape from the face visible of the tape, and the opto-electronic cell 14 detects always the variation in the luminosity visible on the front face of the band 2. This arrangement is particularly adapted to the detection of transversal openings arranged on a composite ribbon tape in order to define the start of each printable zone.

According to another embodiment, the detection means detects the variation in the thickness of the composite ribbon tape, where the latter tape in this case comprises detachable labels. For this purpose, this detection means can comprise a wheel 16 rotatably mounted on an axle 17. This wheel can be brought into pressure contact against the composite ribbon tape and can be disposed in such a fashion as to allow it to turn around itself when the composite ribbon tape carried along. Preferably, the wheel comes in contact with the ink ribbon 4. The axle of the wheel can be perpendicular to the unwinding sense of the composite ribbon tape. The diameter of the wheel 16 can be adapted to the value of the distance interval between two consecutive labels, in order that its movement be detectable when it penetrates into the interval between two labels.

Preferably, the axis of the wheel is fixed to the frame 12 and receives a restraint gauge 18 of a conventional type, for example of the type of a cell where the electric resistance varies depending on its deformation to which it is being subjected to. This gauge 18, fixed in any known manner to the axle of the wheel, can be connected electrically to a measurement bridge, such as a wheatstone bridge, for measuring the representative current of the deformation of the wheel axle. This measurement bridge can be electrically coupled to the member 11A such that the latter can deliver a pulse representative of the passage of the wheel from a hollow or trough to a hump or a bulge, which indicates the presence of a label.

By way of example, the wheel can be mounted at the end of the axle and the length of the axle can be substantially larger than the size of the wheel so as to be able to receive the restraint gauge between said wheel and its other end, which other end can be recessed in the frame 12. The detected parameter can thus be the bending of the axle of the wheel caused by the passage under this latter of the grooves and the bumps of the composite tape corresponding respectively to the intervals between the labels and to the labels.

According to another feature of the invention, the detection member is formed by a wheel 19, rotatably mounted onto an axle 20, placed onto a fork 21, which fork is fixed onto a device 22 for amplification of the rising and descending movement of the wheel. The wheel 19 can be oriented in such a way as to be able to turn on itself during the unwinding of the composite tape.

This device can be fixed to the frame 12 and can be a lever device. This device will be associated with the electric means with the sensors 23 for detection of the low and high positions of a mechanical reference mark 24 fixed on the device. The high and low positions are representative of the position of the wheel, either in a groove of the tape 1, which is characteristic of an interval, or in a bulge of the tape 1, which is characteristic of the presence of a label.

It is evident that the present invention can receive all changes and all variations without however being beyond the scope of the present disclosure.

It will be understood that each of the elements described above, or two or more together, may also find a useful application in other types of tapes and machines using the tape differing from the types described above.

While the invention has been illustrated and described as embodied in the context of a composite tape for label printing machines and machines using the tape, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. Composite tape for a printing machine comprising a band (2) with detachable labels affixed at regular intervals in at least one row;

an ink ribbon having a width equal to that of the band (2) and covering said band and the labels affixed to said band, where said labels include imprintable zones;

wherein the ink ribbon is affixed to the imprintable zones of the labels by electrostatic effect, where the electrostatic effect is brought about by the attractive forces generated by the electrical charges of opposite polarity present on the ink ribbon (4) and on the imprintable zones of the labels, respectively.

2. The composite tape for printing machines according to claim 1, wherein the ink ribbon and the band are affixed additionally one to the other at their respective edges, with the said ink ribbon and the said band being of the same size.

3. The composite tape according to claim 1, wherein the ink ribbon and the band are affixed additionally one to the other outside of the area of the labels by stamping.

4. The composite tape according to claim 1, wherein the ink ribbon and the support band are affixed additionally one to the other by gluing outside of the area of the labels.

5. The composite tape according to claim 1, wherein the ink ribbon and the support band are affixed additionally one to the other by ultrasonic welding outside of the area of the labels.

6. The composite tape according to claim 1, wherein the imprintable zones are formed by an upper face of detachable labels placed at regular intervals along one or several rows, wherein the detachable labels are spaced apart from each other and from the longitudinal edges of the band, wherein this band plays the role of support for the labels and wherein the band is formed by a translucent, silicone-treated paper.

7. The composite tape according to claim 1, wherein the detachable labels, placed onto the band at regular intervals along one or several rows, form imprintable zones with an upper face of a respective label such that the labels are positioned between the band and the ink ribbon, wherein the labels are spaced apart from each other and from the longitudinal edges of the band, wherein this band plays the role of support for the labels and wherein the band is formed by a translucent, silicone-treated paper.

8. A composite tape for printing machines comprising a band with imprintable zones arranged on the band at uniform intervals and providing removable labels;

an ink ribbon having a size no larger than the band, which ink ribbon covers at least the imprintable zones on the band and is affixed to the imprintable zones on the band by electrostatic effect, wherein the electrostatic effect is brought about by the attractive forces generated by the electrical charges of opposite polarity present on the ink ribbon and on the imprintable zones of the labels, respectively.

9. Composite tape according to claim 8, wherein the imprintable zones are formed by an upper face of detachable labels placed at regular intervals along one or several rows, wherein the detachable labels are spaced apart from each other and from the longitudinal edges of the band, wherein this band plays the role of support for the labels and wherein the band is formed by a translucent, silicone-treated paper.

10. Composite tape according to claim 8, further comprising detachable labels placed onto the band at regular intervals along one or several rows for forming imprintable zones with an upper face of a respective label such that the labels are positioned between the band and the ink ribbon, wherein the labels are spaced apart from each other and from the longitudinal edges of the band, wherein this band plays the role of support for the labels and wherein the band is formed by a translucent, silicone-treated paper.

* * * * *